United States Patent [19]

Humphreys et al.

[11] Patent Number: 4,479,687

[45] Date of Patent: Oct. 30, 1984

[54] ELECTRICAL DISTRIBUTION SYSTEM

[75] Inventors: Michael Humphreys, London; John A. Rolfe, Tring, both of England

[73] Assignee: Electrak International Limited, London, England

[21] Appl. No.: 314,819

[22] Filed: Oct. 26, 1981

[30] Foreign Application Priority Data

Oct. 28, 1980 [GB] United Kingdom ..... 8034663
Jul. 1, 1981 [GB] United Kingdom ..... 8120340

[51] Int. Cl.[3] ..... H01R 9/00; H01R 13/44

[52] U.S. Cl. ..... 339/22 B; 339/21 R; 339/43

[58] Field of Search ..... 339/20, 21 R, 22 R, 339/22 B, 23, 24, 36, 43

[56] References Cited

U.S. PATENT DOCUMENTS

| | | | |
|---|---|---|---|
| 1,579,865 | 4/1926 | Hubbell | 339/43 |
| 1,817,034 | 8/1931 | Hotchkin | 339/22 R |
| 2,384,487 | 9/1945 | O'Brien | 339/36 |
| 2,743,423 | 4/1956 | Parks | 339/21 R |
| 3,831,130 | 8/1974 | Valtonen | 339/21 R |
| 3,959,790 | 5/1976 | Schuyler | 339/36 |
| 4,043,626 | 8/1977 | Propst et al. | 339/23 |
| 4,135,775 | 1/1979 | Driscoll | 339/22 R |
| 4,243,284 | 1/1981 | Humphreys | 339/21 R |

FOREIGN PATENT DOCUMENTS

| | | | |
|---|---|---|---|
| 2822883 | 11/1979 | Fed. Rep. of Germany | 339/22 R |
| 927248 | 5/1963 | United Kingdom . | |
| 2026258 | 1/1980 | United Kingdom . | |
| 2095049 | 9/1982 | United Kingdom . | |

*Primary Examiner*—John McQuade
*Assistant Examiner*—Gary F. Paumen
*Attorney, Agent, or Firm*—Krass & Young

[57] ABSTRACT

The invention provides an electrical distribution system comprising a length of conduit 10 containing a plurality of continuous conductors. Electrical access to the conductors is achieved via a contact plug and a series of spaced entry apertures which are shaped to receive the plug in a particular orientation. Safety door means are provided within the conduit for each aperture and are designed to prevent contact with the conductors by means other than the correct contact plug. In one embodiment of the invention, the conduit is in two parts comprising a support section for securing to a supporting surface, and a wall section containing the entry apertures. The wall section can be connected to the support section at any desired location along its length.

9 Claims, 10 Drawing Figures

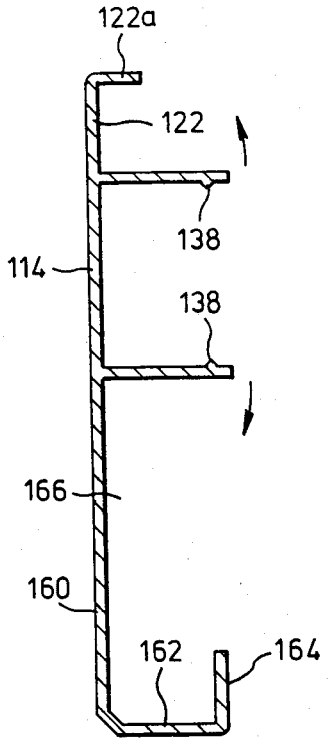
Fig. 8.
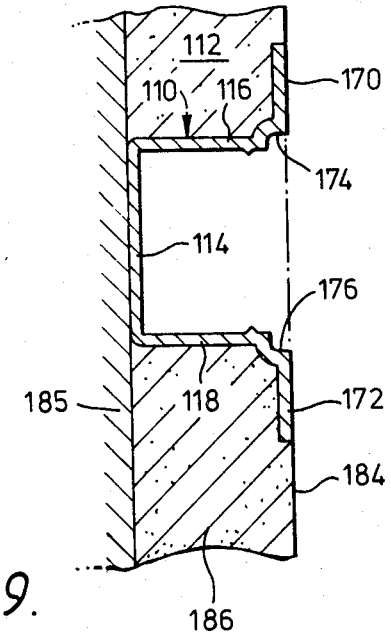
Fig. 9.
Fig. 10.
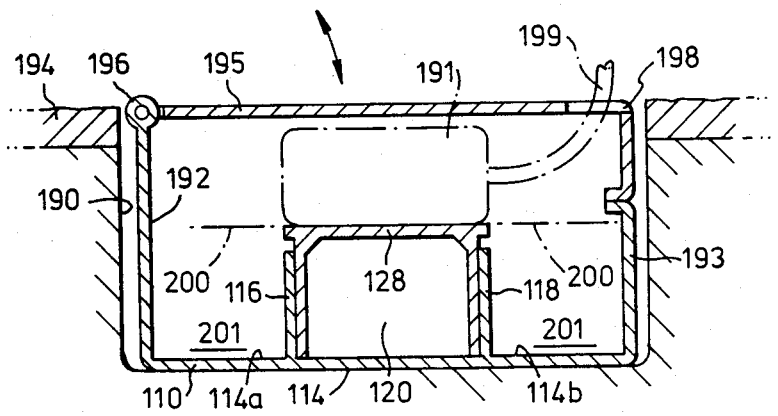

ELECTRICAL DISTRIBUTION SYSTEM

BACKGROUND OF THE INVENTION

This invention relates to an electrical distribution system of the kind comprising a length of hollow conduit enclosing a plurality of continuous electrical conductors, and an aperture in one wall of the conduit through which access to the conductors can be achieved by means of the appropriate contact plug.

An electrical distribution system of this kind is described and claimed in U.S. Pat. No. 4,243,284. In this system, the conduit is formed with a longitudinally-extending entry aperture in one wall through which the contact plug can be inserted; rotation of the plug brings its contact pins into electrical contact with the continuous conductors enclosed within the conduit. A safety arrangement is provided, comprising a series of internal safety doors disposed within the conduit, which are biassed into normally closed positions in which they close off that part of the conduit containing the conductors from the entry aperture. The action of pushing a contact plug into the aperture opens one of these safety doors and enables the plug to be rotated into a position in which the contact pins make electrical contact with the conductors. The design of this safety arrangement makes access to the conductors by means other than the correct plug very difficult.

The present invention provides a modified electrical distribution system of this kind, which has certain advantages in manufacture, and which enables various alternative safety arrangements to be used.

SUMMARY

According to the present invention, there is provided an electrical distribution system comprising a casing adapted to be secured to a supporting surface and having walls defining an elongate housing, a plurality of continuous electrical conductors located within the elongate housing, a plurality of longitudinally spaced entry apertures located at intervals in one wall of the casing each of which define an entry point for a contact plug, and safety closure means associated with each aperture and disposed within the housing, said safety closure means incorporating at least one closure element movable from a closed position preventing access to at least some of said conductors from the respective aperture to an open position in which access to the conductors via the aperture can be achieved.

The use of individually spaced openings simplifies the construction of the casing means forming the housing for the continuous conductors, and enables individual safety closure means to be provided for each entry point.

Preferably, each aperture is shaped such that it can receive a contact plug in only one orientation thereof. This facilitates the entry of the contact plug and assists in positively locating the contact plug when it is moved into the contact position.

The configuration of the housing and the disposition of the conductors therein may be varied to suit the application for which the system is designed, but preferably the housing formed by the walls of the casing means has a generally rectangular cross-section and is adapted to be secured by a rear wall to a flat supporting surface such as a wall. The spaced apertures in this case are advantageously located in the front wall and the continuous electrical conductors are disposed adjacent the upper wall, although other arrangements, such as the disposition of the conductors along the rear wall, may be equally suitable.

The housing may be open on one or more of its sides (for example the rear wall may be omitted) providing the conductors are enclosed when the casing means is fixed to its supporting surface. Suitably, the casing means comprises a length of continuously-manufactured conduit made for example by an extrusion process; the conduit may be unitary, or it may be fabricated from two or more parts.

In the arrangement in which the conductors are located adjacent the upper wall of the housing, in one embodiment each closure element comprises a door mounted opposite a respective aperture for pivotal movement within the housing between its closed and open positions, the door being operable to pivot into an open position when a contact plug is inserted through the respective aperture. Suitably, in one form of the invention, each aperture is provided with a keyway leading into the housing, and in the closed position, the leading edge of the door is advantageously disposed within the housing beyond the margins of the respective opening, but extending over this keyway so that contact with this forward edge to enable the contact plug to open the closure element can be achieved only by entry of an element through this keyway. Such an element is provided on the body of the contact plug, and is shaped to pass through the keyway and engage the leading edge of the door when the contact plug is pushed into an entry aperture.

The use of individual entry apertures provides a space between adjacent apertures which is utilised in an alternative embodiment in which the closure element comprises a door mounted for sliding rather than pivotal movement. Each sliding door is biassed into a closed position extending across the interior of the housing opposite an entry aperture, and can be moved against the bias longitudinally of the housing into the space adjacent the entry aperture, for example by rotation of the contact plug after insertion in the aperture.

In a preferred embodiment of the invention, in addition to said closure element, said safety closure means comprises an entry flap normally biassed into a closed position across said aperture, and in a particular form of this embodiment, the arrangement is such that neither the closure element nor the entry flap can be opened independently of each other.

In one example, the closure element is mounted in the housing such that an attempt to move it into its open position without first opening the entry flap (for example by inserting an element through the keyway) causes it to jam on the entry flap. In another embodiment, the entry flap is prevented from opening by abutment with the closure element in its closed position; in order to gain entry to the conduit, a key element (such as is provided on the contact plug) must be inserted through the keyway to engage the closure element, which is then opened simultaneously or slightly in advance of, the entry flap.

Conventional distribution systems which do not rely on continuous conduits and multiple entry points generally incorporate a number of fixed socket outlets which provide individual electrical access to the system by means of the appropriate contact plug. Such systems suffer from a number of disadvantages, many of which relate to the permanence with which they are incorporated into a building. For example, the conductor cable which interconnects the various socket outlets is normally concealed within the wall, and because of this it is usually impossible to move socket outlets, or to add new ones to the system, without disturbing the wall surface. Furthermore, when a building is being constructed or refurbished, it is often impossible for the eventual occupant of the building to be consulted over the location of socket outlets, and as a result, these are often incorrectly located when the building is finally occupied. Although trunking systems have been proposed for industrial and commercial applications, these are significantly more expensive than conventional arrangements and in some applications do not offer the desired versatility.

In order to overcome these disadvantages, in one form of the invention, the casing means is formed in two parts, comprising a first part adapted to be permanently secured to a supporting surface, and a second part which is formed with the entry apertures. This enables the first part to be formed as a longitudinally-extending support section of indefinite length, and the second part to form a wall section of any length and which can be secured to the support section at any one of a number of longitudinally-extending locations to form the completed conduit.

Suitably, the wall section is removably connected to said support section, whereby the position of said wall section can be changed to another of said locations when desired.

Preferably, the longitudinally-extending support section is manufactured continuously and can be cut to any desired length, and when the electrical distribution system is initially assembled, said wall section is disposed in the support section at the most suitable location. Should the requirements of the user change at any time, the wall section may be re-positioned within the support section at a different location.

Preferably, one length of support section is adapted to receive a plurality of said wall sections, and these are suitably interconnected electrically within the completed conduit.

In one embodiment of the invention, the continuous conductors are disposed within the support section; in another embodiment, they are disposed in the wall section. In this latter embodiment, individual wall sections mounted in a common support are interconnected electrically by conductors disposed within the conduit.

The support section is advantageously adapted to be fixed permanently to a surface, for example it may be partially concealed within a wall surface, and it is intended to act as a permanent support of the wall sections containing the entry apertures, whilst allowing the wall sections to be moved or added to without necessitating any disturbance of the wall surface.

Lengths of support section can be fitted into a new building without requiring a skilled electrician; when the building is substantially completed, the electrician can locate the wall sections and any other appropriate fittings in the supports according to the user's requirements.

In one embodiment of the invention, the support section comprises a generally U-shaped channel section intended to be fitted onto a wall surface with the channel facing outwardly. The wall section with the entry apertures therein is intended to be mounted within the channel section and is fitted from the front; preferably the wall section is adapted to be clipped into the channel section and several can be located at intervals along the length of the section. Open parts of the channel section, for example the spaces between adjacent wall sections, can be closed off with cover members, such as cover plates, which may also be adapted to be clipped into position.

The invention may in addition comprise a contact plug adapted to engage with one of said entry apertures and to make electrical contact with the continuous conductors located within said housing.

BRIEF DESCRIPTION OF THE DRAWINGS

FIGS. 8 and 9 are sections through alternative forms of housing; and

FIG. 10 is a section taken through a distribution system intended for under-floor mounting.

DETAILED DESCRIPTION OF THE PREFERRED EMBODIMENTS

Figure 1:
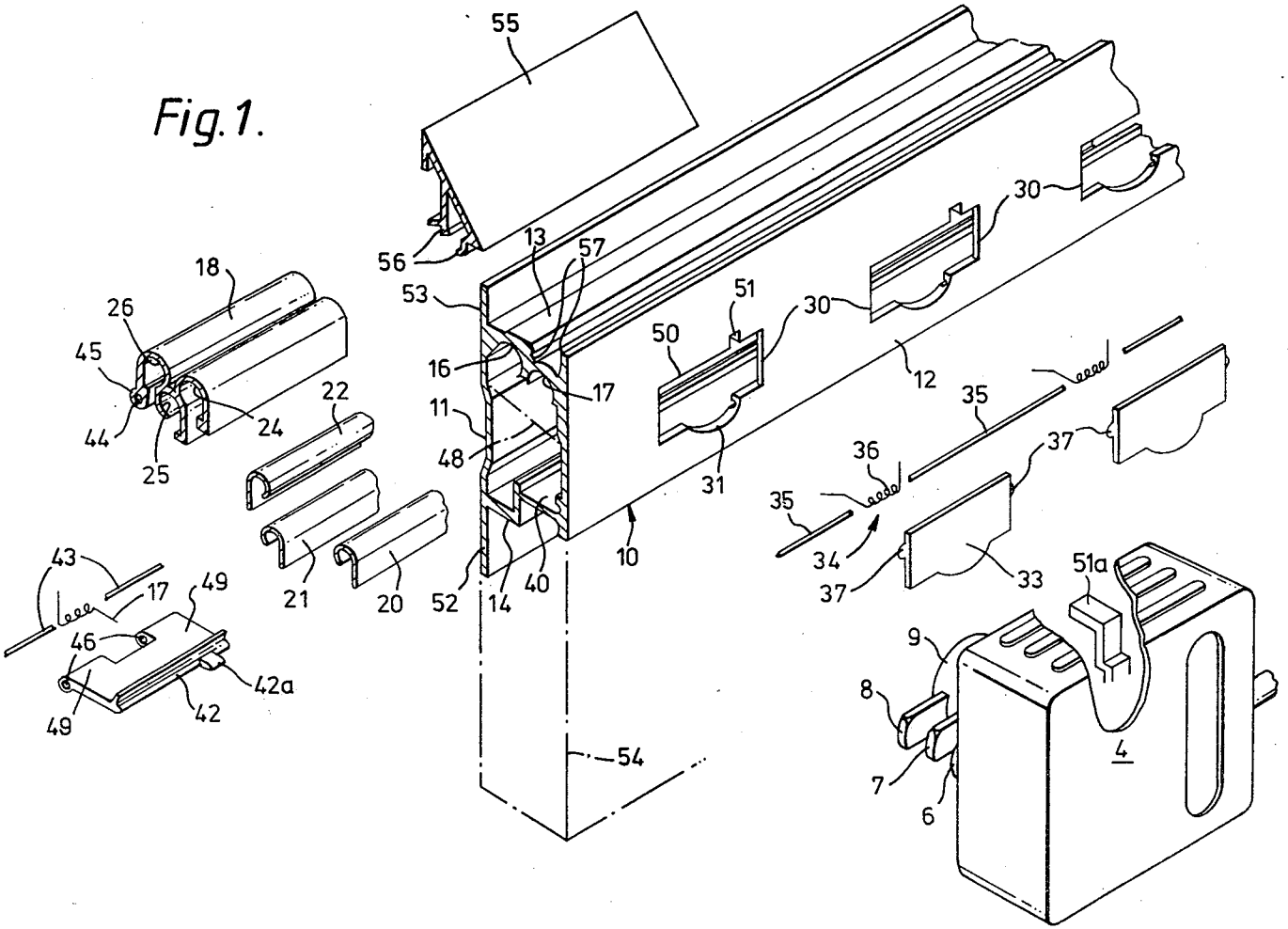
FIG. 1 is an exploded perspective view of an electrical distribution system mounted on a wall surface, including a typical contact plug.

In the drawings, the same references are used to designate the same or similar part.

Referring to the drawings, FIG. 1 shows an electrical distribution system comprising casing means in the form of a length of hollow conduit 10 of generally rectangular box-section construction having a rear wall 11, a front wall 12, an upper wall 13, and a lower wall 14. The conduit is preferably manufactured by extrusion and may be made of any suitable conductive or non-conductive material such as metal or plastics. In the example illustrated, the conduit is formed from aluminium as a one-piece extrusion, although it may be made in two or more separate parts which are subsequently assembled together, e.g. the conduit may be made as separate front and rear halves. The latter arrangement may assist in assembly of the various components.

The walls of the conduit define a generally rectangular housing and upper wall 13 is shaped on its inside surface to provide a pair of longitudinally extending grooves 16, 17 which are generally semi-circular in cross-section and which form interlocking formations for a conductor support 18 extruded from a resilient non-conductive plastics material. This conductor support 18 is intended to receive three continuous electrical conductors 20, 21, 22 and for this purpose defines three insulated half-sleeves 24, 25, 26 into which the conductors can be fitted. The conductors are of inverted U-shape in cross-section to enable optimum contact with contact pins 6, 7 and 8 of contact plug 4, as will be described, and the conductor support 18 defines three entry slots along its lower edge for access to the conductors by the pins of the contact plug. The conductors are made of any suitable electrically conductive material such as brass or copper.

When the conductors 20, 21, 22 are received within the respective sleeves 24, 25, 26, the conductor support becomes a friction fit in the grooves 16 and 17 provided in the upper wall 13, and further location is provided by the front and rear walls 12 and 11.

A series of entry openings 30 are provided in the front wall 12 of the conduit 10. These entry openings 30 are cut out of the front wall 12 by e.g. a stamping or punching operation, and define entry positions for the contact plug 4 (which is similar to the plug shown in U.K. Patent Application No. 7924492). The plug is fitted into an opening on its side (as shown) and can then be rotated so that its contact pins 6, 7, 8 engage the conductors 20, 21, 22 respectively.

Each entry opening 30 is provided with an entry flap 33 which covers the entry opening when a plug is not in position. Each entry flap 33 is mounted for pivotal movement about the lower edge of opening 30 on a pin assembly 34, which comprises, for each entry flap, two pins 35 and a torsion spring 36. The pins 35 are received in grooves formed in the rear face of a lower profiled portion 33*a* of each door 33, these profiled portions being received in correspondingly-shaped enlargements 31 of the respective opening 30. The entry flap 33 is biassed by spring 36 into a closed position where it is retained by ears 37 which engage the inside edges of the openings in the front wall 12. When a contact plug is inserted into an opening 30, the respective flap 33 is pushed downwardly by end portion 9 of the plug and pivots into the space 40 provided in the lower wall 14 of the conduit. The spring action against the end portion 9 of the contact plug 4 when the entry flap is in this folded position urges the plug upwardly in the conduit and improves contact with the conductors 20, 21, and 22.

Figure 2:
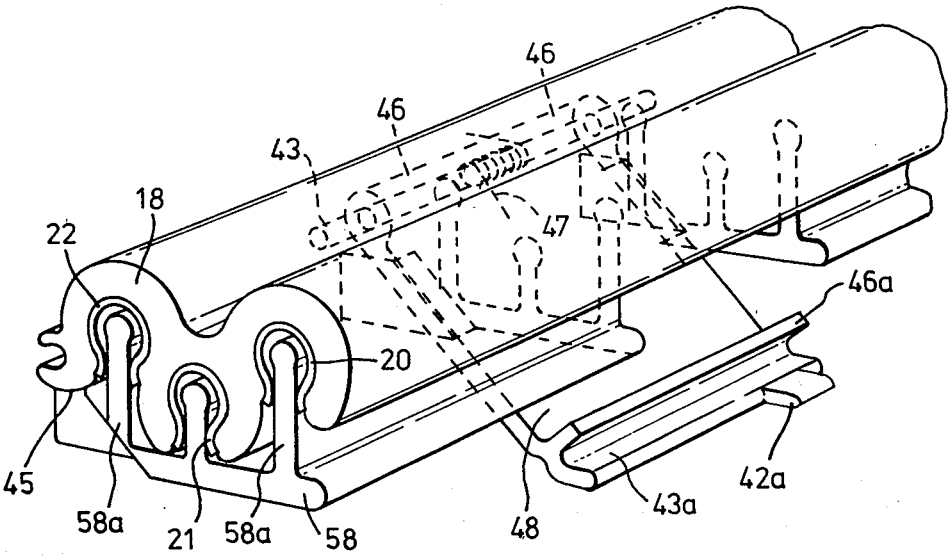
FIG. 2 is a perspective diagrammatic view showing details of the conductor support and safety door arrangements of an electrical distribution system similar to that shown in FIG. 1.
Figure 3:
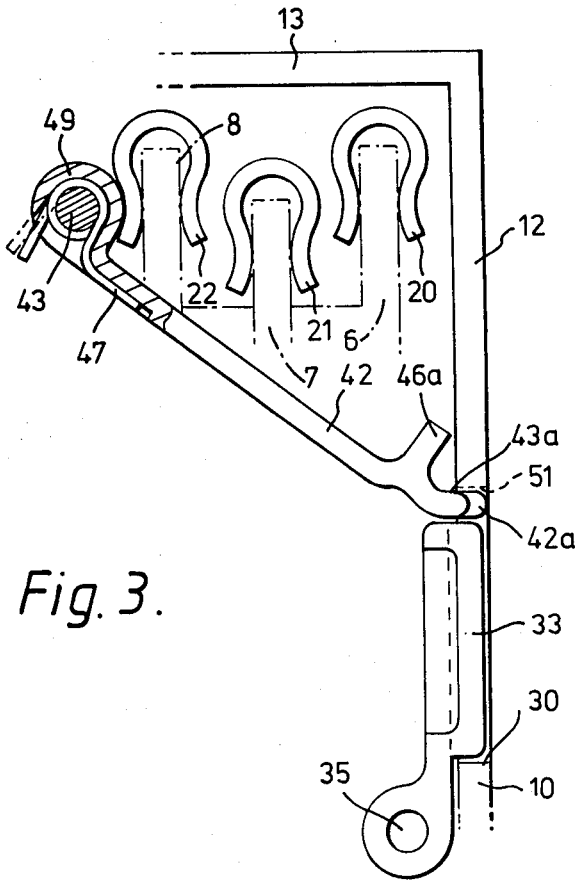
FIG. 3 is a vertical sectional view of the parts of the electrical distribution system shown in FIG. 2, showing details of the entry flap and safety door arrangements.

The conduit 10 is provided with safety closure means intended to prevent access to the conductors even though entry to the interior of the conduit has been achieved via an opening 30. These safety closure means, details of which are shown in FIGS. 2 and 3, comprise a series of doors 42, one located opposite each aperture 30, and which are biassed into a closed position in which they close off the upper part of the conduit 10 containing the conductors 20, 21 and 22 from the part of the conduit in which the openings 30 are located. In the embodiments shown in FIGS. 1 to 3, each door is pivotally mounted on pins 43 located in a bore 44 formed in a support 45 comprising the enlarged rearmost edge of the conductor support 18. The door 42 receives the pins 43 in bores 46 formed in lugs 49 extending from the rear edge of the door, and a torsion spring 47 is provided arranged to bias the door 42 into a closed position in which it extends diagonally across the conduit as shown roughly by dotted lines 48 in FIG. 1. Sections of the support 45 are cut out to receive the lugs 49 of door 42 in which the bores 46 are located.

When the doors 42 are in their closed position, their forward edge is located above the upper edge 50 of the openings 30 with the result that it is extremely difficult to open these doors from inside the conduit even though access into the interior of the conduit has been achieved via an entry flap 33. Doors 42 can in fact only be opened from the outside by passage of an element through a keyway 51 which is provided in the upper edge of each opening 30. Furthermore, it will be seen from FIG. 3 that the geometry of the safety doors 42 and associated entry flaps 33 is such that a safety door cannot be opened (for example by pushing a pin or screwdriver through keyway 51) without first opening entry flap 33, because if this is attempted a lug 42*a* provided on the leading edge 43*a* of the safety door jams on the upper edge of entry flap 33.

An additional safety feature is provided on safety door 42. The leading edge 43*a* of the safety door incorporates an upwardly and outwardly projecting lip 46*a* which acts as a barrier to prevent a thin tool, a pin or similar item, from being pushed through the keyway and towards the conductors without the safety door and entry flap having first been opened.

The contact plug 4 intended for use with the system is provided with a projection (not shown) which fits in keyway 51 and which can engage lug 42*a;* when the plug is pushed into the entry aperture, this projection is engaged in keyway 51. As the contact plug is pushed in, the entry flap is opened and the element on the plug body abuts the lug 42*a* and pivots the door 42 downwardly into an open position; the plug can then be rotated to bring its contact pins into electrical contact with the conductors 20, 21 and 22.

The conductors shown in FIGS. 2 and 3 are of slightly different shape to those illustrated in FIG. 1, in that the downwardly-extending arms of the U-sections are of equal length and are spring loaded so as to grip the contact pins of the plug in the contact position, as illustrated in FIG. 3.

The length of each door 42 is greater than the length of the respective aperture so that the doors extend beyond the lateral edges of the openings; blanking inserts 58 (FIG. 2) are pushed into the conductors 20, 21, 22 between adjacent safety doors 42 and for this purpose are provided with legs 58*a* which are a snap fit into the conductors. Alternatively, these blanking inserts may be moulded integrally with the conductors support 18. If required, in another embodiment the doors may be long enough to extend to a point midway between adjacent openings 30 so that there is no appreciable gap between successive doors.

Preferably, both the safety doors 42 and the entry flaps 33 are snapped into place on their pivot pins so that they can be replaced if they become broken.

The rear wall 11 of the conduit 10 is extended at its upper and lower margins to form flanges 52, 53 intended for securing the conduit to a suitable surface such as a wall. As shown in FIG. 1 in dotted lines 54, the conduit can be secured to the upper edge of a skirting board or like trim member, and a triangular finishing element 55 is provided with interlocking formations 56 which can be engaged with corresponding formations 57 formed on the upper wall 13 of the conduit 10.

Figure 4:
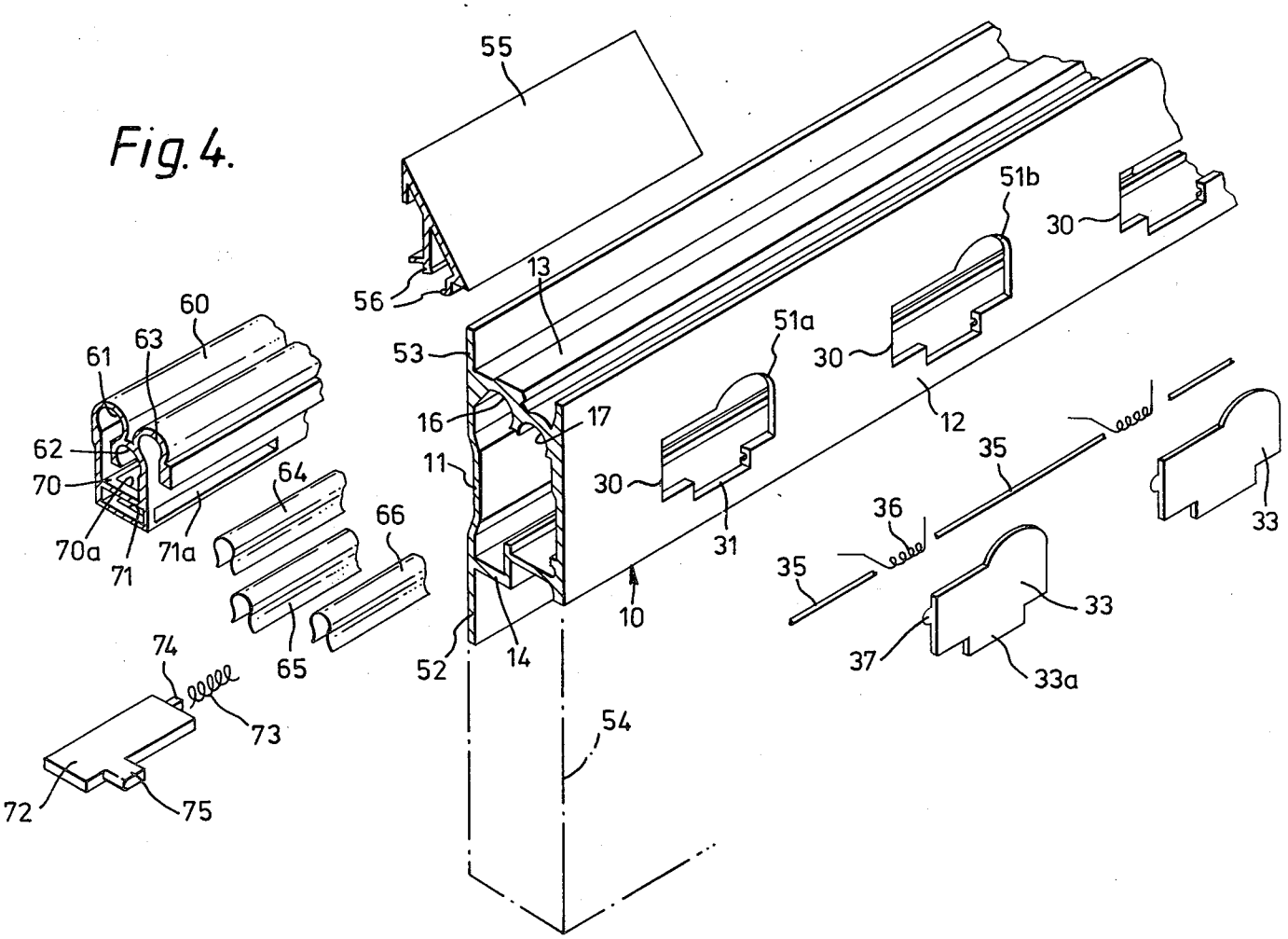
FIG. 4 is an exploded perspective view of an alternative electrical distribution system mounted on a wall surface.

FIG. 4 illustrates an alternative arrangement of internal safety door which is made possible by the use of separate, spaced openings in the front wall of the conduit. In this arrangement, plug 4 and conduit 10 are generally similar to those used in the construction shown in FIG. 1, but the conductor support and safety door arrangements are different.

In the embodiment shown in FIG. 2, the conductor support 60 as before is extruded from resilient plastics material and defines three longitudinal channels 61, 62, 63 which receive conductors 64, 65, 66 respectively.

Also as previously, when the conductors are fitted into these channels the support 60 becomes an interference fit in the interlocking formations 16 and 17 formed along the upper wall 13 of the conduit 10. In this case, the conductors 64, 65 and 66 are similar to those in FIGS. 2 and 3 (i.e. inverted U-section with resilient arms) but other formations are possible such as circular- or square-section rods formed with a longitudinal slot adapted to receive the contact pins of the contact plug.

The conductor support 60 is formed with downwardly-depending longitudinal walls 68 and 69 which are interconnected by a base 70 which closes off the live and neutral conductors 64 and 65. This base is cut out at intervals to form openings 70*a*, and the marginal lower edges of walls 68 and 69 are formed with channels 71 which together define a horizontal guide slot 71*a* for a sliding safety door 72, which can slide freely within the slot 71*a* and which is located by this slot and by the inside front and rear wall 12 and 11 of the conduit 10. Each door 72 can move between a closed position in which it is disposed opposite an opening 30, to an open position where it is located in the space between adjacent openings 30. Each door is biassed into its closed position by a coil spring 73 which is located by an ear 74 on the adjacent lateral edge of door 72, and which bears on the far side of the opening 70*a*.

Door 72 is also provided with a forwardly-projecting lug 75 on its front edge, and when a plug is inserted into an opening 30, this lug engages the plug body as it is rotated into its contact position; this rotation causes the door 72 to slide open to enable the contact pins of the plug to reach the conductors.

The reverse procedure of removing the contact plug causes the door to slide, under the action of spring 73, into a closed position as the plug is rotated prior to removal.

It will be noted that door 72 extends across conductors 64 and 65 only; conductor 66 is not protected by the safety door. This is because conductor 66 is the earth conductor and safety provision is therefore unnecessary. In an alternative arrangement, the separate earth conductor 66 is dispensed with, and this is comprised by the metal conduit itself. In certain arrangements, the earth conductor can be dispensed with altogether.

It will be noted that the sliding action of door 72 makes it unnecessary to provide a keyway 51 in the openings 30. These openings 30, and the corresponding entry flaps 33 do however differ from those shown in FIG. 1 in that one side of the opening is provided with an enlarged rounded profile 51*a*. This profile engages the plug body when it is rotated into its contact position and prevents sideways movement of the plug.

Instead of providing openings 70*a* at intervals in the lower wall 70 of the conductor support 60, this wall may be eliminated and blanking pieces fitted as in the previously described embodiment. In the arrangement shown in the drawing, the openings 70*a* are provided at intervals of approximately 25 mm.

In the embodiments shown in FIGS. 5 to 10, instead of the conduit being of unitary construction, it is formed of two parts comprising a support section in the form of a generally channel-shaped housing 110 and a wall section comprising a socket outlet plate 128. The support section comprising the housing 110 is intended to be fixed permanently to a wall surface and is formed with a rear wall 114, and upper and lower walls 116 and 118 respectively, these defining an outwardly-facing central channel 120.

The rear wall 114 extends beyond the upper and lower walls to form upper and lower flanges 122 and 124 respectively by which the housing may be secured to a supporting surface such as a wall, for example by screws. These flanges terminate in outwardly-turned edges 122*a*, 124*a* which may be used to retain trim elements 126 (shown in broken lines, FIG. 6).

Figure 5:
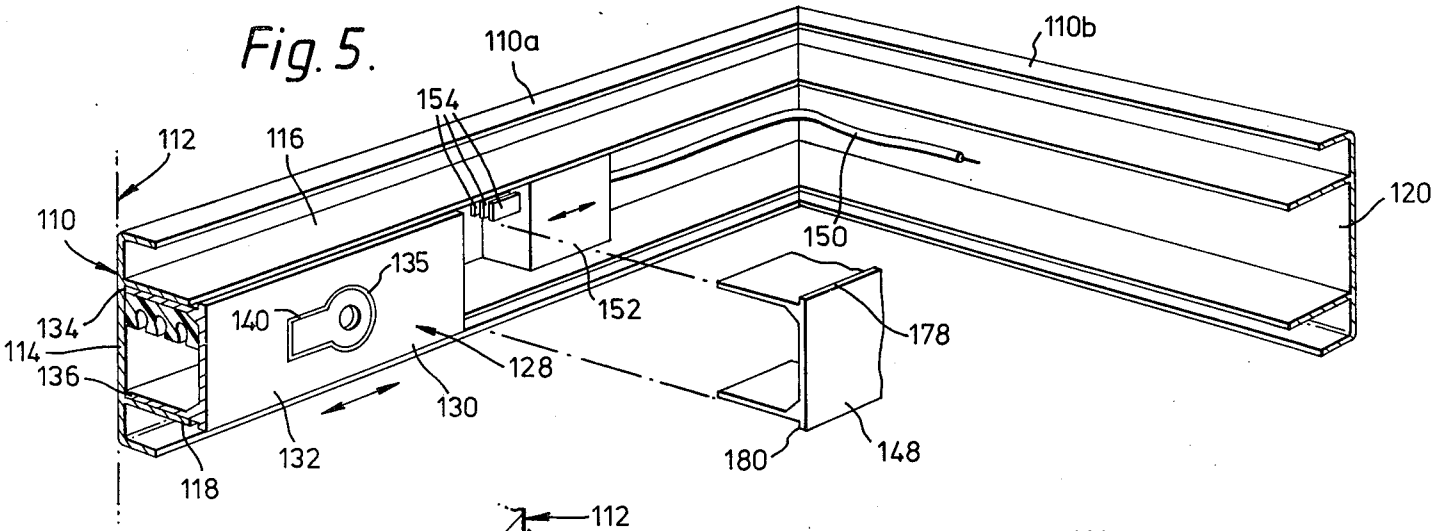
FIG. 5 is a perspective view, partially broken away, of another electrical distribution system, mounted on a wall surface.

The housing 110 is preferably manufactured as a continuous extrusion from a plastics material such as PVC or a light metal material such as aluminium alloy, although it may be produced by rolling a material such as mild steel sheet; it is cut to the exact length required before it is fitted permanently into the wall. FIG. 5 shows two such lengths of housing, 110*a* and 110*b*, fitted into a corner of a room immediately above a skirting board, and mitred into the corner to provide a perfect join. In a new building, this housing can be incorporated into a wall structure some time before the electrical conductors and accessories are fitted, and such fitting does not require the presence of a skilled electrician unlike conventional systems where the power cables must first be buried into the wall surfaces.

The housing 110 is adapted to support a wall section in the form of a socket outlet plate 128 at any point along its length. Several of these socket outlet plates 128 can be received within the central channel 120 of one length of housing and each comprise a casing 130 of complimentary channel section to channel 120, casing 130 comprising a front wall 132, upper wall 134, and lower wall 136. As will be seen from FIG. 6, these walls 134, 136, fit exactly within walls 116, 118 of housing 110, and are suitably made an interference or clip fit by means of projections 138 engaging corresponding channels 138*a* formed along the innermost margins of outer surfaces of walls 134 and 136, although they may be secured within the housing by other means, for example they may be screwed into the housing.

Figure 6:
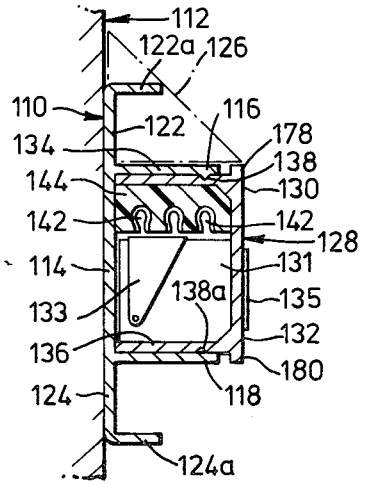
FIG. 6 is a vertical cross-section taken through the housing shown in FIG. 5.

Each socket outlet plate 128 incorporates a plurality of entry points 140 for a contact plug, allowing access to the continuous conductors 142 supported in a conductor support 144 located at the top of the casing 130. The conductors are protected by a safety door system which may be as described in connection with FIGS. 1 to 4. FIG. 6 illustrates this latter system; 131 designates the rectangular housing of the modular assembly, 133 the safety shutter, and 135 (see also FIG. 5) the peripheral locating bead.

Figure 7:
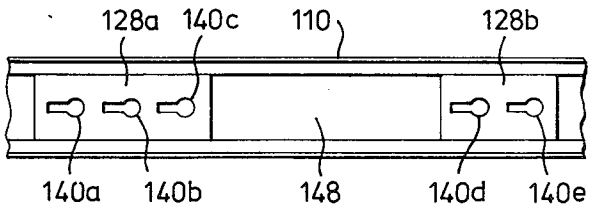
FIG. 7 is a front elevation of an electrical distribution system similar to that shown in FIGS. 5 and 6, in an assembled condition.

A socket outlet plate having only one entry point 140 is shown in FIG. 5 for clarity, but according to the invention each socket outlet plate has more than one plug entry point, for example two or three are generally more convenient. A typical system is shown in FIG. 7, where two socket outlet plates 128*a*, 128*b*, are illustrated. Socket outlet plate 128*a* has three plug entry points 140*a*, 140*b* and 140*c*, whereas socket outlet plate 128*b* has two entry points 140*d* and 140*e*.

It will be appreciated that the number and disposition of socket outlet plates 128 provided in each length of housing, and the number of plug entry points 140 in each socket outlet plate, will depend entirely on the requirements of the user; for example where there is no requirement for any electrical access into the supply circuit, socket outlet plates may be omitted from a complete length of housing; where a large number of plug entry points are required, the entire length of the housing may incorporate a socket outlet plate provided with a number of closely-spaced plug entry points. For this purpose, casing 130 of the socket outlet plate 128 can be made in a number of standard but varying lengths with the plug entry points at varying spacings and distributions. In a particularly advantageous arrangement, the system may incorporate socket outlet plates adapted to accept more than one type of entry plug, the "plug-in" arrangement of the socket outlet plates enabling different configurations of socket outlet plates to be incorporated in a single length of housing.

The interlocking system shown in FIG. 5 is designed to allow a socket outlet plate 128 to be clipped into the channel section and then slid along the housing 110 until it is in the desired location. Its position is then fixed by a cover strip 148 which is of a similar section to casing 130 and which is manufactured in continuous lengths similar to casing 110, and of a similar material such as PVC or aluminium. These cover strips 148 are cut to the exact length required to bridge the gap between adjacent socket outlet plates 128*a*, 128*b* (FIG. 7) and at the same time close off the interior of the housing from the outside. This provides a neat, finished appearance to the conduit and also conceals the cable conductors 150 which interconnect adjacent socket outlet plates. As will be seen from FIG. 5, a length of interconnecting cable 150 terminates in a plug-in cable connector 152 which is provided with contact pins 154 which plug into the inverted U-shaped conductors 142 provided in each socket outlet plate 128. This arrangement provides a rapid and convenient method of interconnecting adjacent socket outlet plates in the system. Where two socket outlet plates are located side-by-side, simple, push-in connectors (not shown) are provided for electrically interconnecting the two plates. It will be appreciated that such connections, which are much quicker and simpler than conventional screw-type terminals, are considerably facilitated by the use of the continuous conductors 142 incorporated into the socket outlet plates 128.

Alternative sections of housing are shown in FIGS. 8 and 9. In FIG. 8, the lower extension 160 of the rear wall 114 extends downwardly to form a lower web of considerable depth. This terminates in a horizontal flange 162 and upwardly-turned lip 164, which together define a lower housing 166 which can be used to enclose items such as additional conductor cables or central heating pipework. A cover plate (not shown) is fitted over the channel 166 and this forms a skirting board in the finished room.

FIG. 9 illustrates a housing 110 which is intended to be buried completely in a wall surface. In this arrangement, upper and lower flanges 170, 172 are provided respectively along the front edges of upper and lower walls 116 and 118, and these are provided with longitudinal recesses 174, 176 which are adapted to receive the upper and lower flanges 178, 180 of front wall 130 of a socket outlet plate 128. Similar flanges 178, 180 are provided along the cover strip 148. Flanges 170, 172 are intended to be recessed into the wall surface, as shown in FIG. 9, and recesses 174, 176 ensure that the socket outlet plates and the cover elements are positioned exactly flush with the front surface 184 of the wall 112. Ideally, in a conventional building, the rear wall 114 of the housing 110 is secured to the brickwork 185 of the wall, for example by screws, and the depth of housing 110 is substantially equal to the depth 186 of the plaster finish. This greatly facilitates fitting of the housing into a new building and results in a neat finished appearance to the system.

FIG. 10 illustrates the distribution system of the invention applied to an under-floor distribution arrangement such as might be used for example in an office. This same arrangement may also be used in a recessed position in a desk, console or other furniture unit. In this system, the housing 110, which is preferably made from a rolled section such as mild steel, is fitted into a recess 190 formed in the floor surface, and the central channel 120, which is again defined between rear wall 114 and walls 116 and 118, faces upwardly. The socket outlet plates 128 are fitted into the channel 120 in exactly the same manner as described in connection with FIGS. 5, 6 and 7 although in this case they face upwardly and are adapted to receive a contact plug 191 fitted in from above.

As will be seen from FIG. 10, rear wall 114 is extended by horizontal webs 114*a*, 114*b*, which terminate in longitudinally extending vertical flanges 192, 193. The height of flange 192 is substantially that of the floor recess 190 plus any floor covering 194, and the upper edge of this is used to mount thereon a cover panel 195 which lies flush with the floor surface and which is supported at its other edge on flange 193. Where a socket outlet plate 128 is provided in the housing 110, these cover panels 195 are hinged at 196 so that they can be lifted to expose the plug entry points. The depth of the housing 110 is sufficient to accommodate the socket outlet plate and a contact plug 191, and when a contact plug has been fitted into a plug entry point, the hinged cover plate 195 may be lowered so that the cover plate again lies in the plane of the floor. One or more slots 198 are provided in the free edge of the hinged cover plate to enable the cable 199 of the contact plug to be passed through. This system overcomes the disadvantage of conventional recessed floor fittings which usually remain with the hinged cover in an open position when a plug is fitted into the socket outlet. Trim panels, shown in broken lines at 200, close off the lower part of the housing to form channels 201 which may be used for carrying telephone, telex or other electrical cables.

It will be appreciated that various alternative arrangements are possible in accordance with the invention. For example, in a variation of the safety arrangements of FIGS. 1 to 3, in the closed position the front edge of the safety door 42 engages the rear face of the associated entry flap, thus preventing the flap from opening. Before the flap can move downwardly into the open position, a protruding element on the plug body must be inserted through the keyway to engage the safety door, which is then pivoted simultaneously with the entry flap into the open position.

Safety doors need only be provided over live and neutral conductors.

In an alternative arrangement, the safety door comprises a cylindrical housing arranged with an open end facing the respective opening and which receives the contact pin assembly of the contact plug. The cylindrical housing is rotatable with the plug to enable the pins to contact the conductors but cannot be turned into the open position until the plug has been pushed fully home in the direction of the rear wall of the conduit. The opening is protected as before with one or more entry flaps.

In any of the embodiments referred to herein, a short length of conduit may be used to form a single socket outlet, and in addition to the support section in FIGS. 5 to 10 being cut to length, the wall sections may also be continuously produced and cut to a desired size.

It will also be appreciated that the entry apertures may be designed to accept contact plugs which are different from those illustrated, i.e. conventional two- and three-pin plugs. For this purpose each entry aperture may comprise two or more openings adapted to receive the respective pins.

We claim:

1. An electrical distribution system comprising the combination of a casing having walls defining an elongate rectangular housing; a plurality of elongate conductor rails mounted within the housing to extend adjacent a first wall thereof; and a contact plug having contact pins intended for making electrical contact with said conductor rails, said conductor rails being of a constant cross-section which is open in the direction away from the first wall and is operable to receive said contact pins; and said housing being formed with a plurality of longitudinally spaced apertures located at intervals in a second wall of said housing which second walls lies adjacent said first wall, each of said apertures providing an entry point for a said contact plug and each said aperture being defined, at least in part, by an arcuate guide surface co-operable with a corresponding arcuate guide surface formed on said contact plug whereby on insertion of a said contact plug in an aperture, rotation causes the contact pins of said plug to pass into the open section of said conductor rails and make electrical contact therewith; and safety closure means associated with each said aperture disposed within said housing, each said safety closure means comprising at least one closure element movable on rotation of said contact plug from a closed position preventing access to at least some of said conductor rails from the respective aperture to an open position in which access to the conductor rails via the aperture can be achieved.

2. An electrical distribution system as claimed in claim 1, wherein each said aperture is shaped such that it can receive a contact plug in only one orientation thereof.

3. An electrical distribution system as claimed in claim 1, wherein said casing is adapted to be mounted to extend generally horizontally on a substantially vertical supporting surface, and the conductor rails are disposed along the upper wall of the casing while the apertures are disposed in the front wall thereof.

4. An electrical distribution system as claimed in claim 1, wherein said closure element is slidably mounted within said housing and is slidable longitudinally of the casing between its closed and open positions.

5. An electrical distribution system as claimed in claim 4 further comprising biassing means operable to bias said closure element into its closed position.

6. An electrical distribution system as claimed in claim 1 wherein each said safety closure means comprises, in addition to said closure element, an entry flap extending across said aperture, said entry flap being movable between an open position and a closed position, and biassing means biassing said entry flap into said closed position.

7. An electrical distribution system as claimed in claim 1, wherein said contact plug comprises a plug body; a spigot extending from the plug body; and a plurality of contact pins extending at right angles to the axis of said spigot for engagement with said open section conductor rails; and said arcuate guide surface is formed on said spigot.

8. An electrical distribution system comprising the combination of a first casing part adapted to be secured to a supporting surface, and a second casing part adapted to be releasably supported by the first casing part, said casing parts defining an elongate rectangular housing; a plurality of elongate conductor rails carried by said second casing part which elongate conductor rails are mounted within the housing to extend adjacent a first wall thereof; and a contact plug having contact pins intended for making electrical contact with said conductor rails, said conductor rails being of constant cross-section which is open in the direction away from the first wall and being operable to receive said contact pins; and said second casing part being formed with a plurality of longitudinally spaced apertures located at intervals in a second wall of said housing which second wall lies adjacent said first wall, each of said apertures providing an entry point for a said contact plug and each said aperture being defined, at least in part, by an arcuate guide surface co-operable with a corresponding arcuate guide surface formed on said contact plug whereby on insertion of a said contact plug into an aperture, rotation thereof about said co-operating guide surfaces causes the contact pins of said plug to pass into the open section of said conductor rails and make electrical contact therewith; and safety closure means associated with each said aperture disposed within said housing, each said safety closure means comprising at least one closure element movable on rotation of said contact plug from a closed position preventing access to at least some of said conductor rails from the respective aperture to an open position in which access to the conductor rails via the aperture can be achieved.

9. An electrical distribution system as claimed in claim 8, wherein said first casing part comprises a rear wall adapted to be secured to a vertical supporting surface, and spaced upper and lower walls extending at right angles to said rear wall to define a C-shaped support section; and said second casing part comprises a front wall formed with said spaced apertures and intended to be disposed in a substantially vertical plane; and upper and lower walls extending at right angles to said front wall to define a C-shaped section, said open section conductor rails being disposed adjacent said upper wall; wherein when the first and second casing parts are assembled together, the upper and lower walls of the second casing part are disposed between and adjacent the upper and lower walls respectively of the first casing part.

* * * * *